United States Patent [19]

Dominici et al.

[11] 4,443,937

[45] Apr. 24, 1984

[54] METHOD FOR MAKING AN ELECTRICAL CONNECTOR PIN

[75] Inventors: Jean P. Dominici; Michel Morànd, both of Cluses, France

[73] Assignee: Souriau-Cluses (S.A.), Boulogne, France

[21] Appl. No.: 365,682

[22] Filed: Apr. 5, 1982

[30] Foreign Application Priority Data

Apr. 24, 1981 [FR] France ..... 81 08168

[51] Int. Cl.[3] ..... H01R 43/00

[52] U.S. Cl. ..... 29/874; 29/564; 82/2.5; 408/44; 408/70

[58] Field of Search ..... 29/430, 559, 561, 563, 29/564, 568, 874, 882, 33 R, 33 M, 33 P; 408/234, 44, 45, 70; 409/235; 82/2.5, 27

[56] References Cited

U.S. PATENT DOCUMENTS

| | | | |
|---|---|---|---|
| 1,871,077 | 8/1932 | Mowat . | |
| 2,302,878 | 11/1942 | Muhl et al. | 408/70 X |
| 2,895,354 | 7/1959 | Hawkinson et al. | 408/44 X |
| 3,651,958 | 3/1972 | Evans et al. | 82/2.5 X |
| 3,874,048 | 4/1975 | Millar et al. | 29/568 x |
| 3,926,078 | 12/1975 | Ishizuka et al. | 82/2.5 |
| 4,064,774 | 12/1977 | Maddock | 82/2.5 X |
| 4,097,984 | 7/1978 | Petrov | 82/2.5 X |
| 4,317,394 | 3/1982 | Link et al. | 82/2.5 |
| 4,335,507 | 6/1982 | Shibata | 29/874 |

FOREIGN PATENT DOCUMENTS

| | | |
|---|---|---|
| 2448545 | 4/1976 | Fed. Rep. of Germany . |
| 340111 | 9/1959 | Switzerland . |
| 341695 | 11/1959 | Switzerland . |
| 1567587 | 5/1980 | United Kingdom . |

*Primary Examiner*—Howard N. Goldberg
*Assistant Examiner*—Carl J. Arbes
*Attorney, Agent, or Firm*—Sughrue, Mion, Zinn, Macpeak & Seas

[57] ABSTRACT

The present invention relates to the method and apparatus for manufacturing electrical connector pins. The method and apparatus make it possible to manufacture a pin from a blank of oblong shape (10), this blank being machined at different locations while held alternately by its ends (10A and 10B), the blank being moved from one location to another always substantially parallel to itself by means of gripping arms (27, 28, 61, and 60).

5 Claims, 2 Drawing Figures

METHOD FOR MAKING AN ELECTRICAL CONNECTOR PIN

FIELD OF THE INVENTION

The present invention concerns methods for making electrical connector pins.

BACKGROUND OF THE INVENTION

It is known that a pin on an electrical connector generally consists of a substantially cylindrical part involving a certain number of machining operations such as boring, milling, undercutting, broaching, drilling, tapping, threading, cut-off, deburring, surfacing, folding and/or bending.

All these machining operations are presently carried out in a certain number of locations, the partially machined workpiece being moved after each operation.

For example, the workpiece having undergone a first machining operation on a first machine is then handled for placement on a second machine at a different location to undergo further machining.

It is hence easily conceivable that all these machining and handling operations require time.

To deal with these requirements, certain industries have developed machine-tools equivalent to robots which pick up a blank and which, from this blank, deliver the completely machined part without human intervention.

However, these robots are not specially designed for the manufacture of electrical connector pins.

Hence, machine-tools equivalent to these robots are too sophisticated, complex and hence costly to be profitable in the manufacture of parts such as pins for electrical connectors.

It is the object of the present invention to overcome the problems arising from the present lack of machines specially designed for the manufacture of electrical connector pins by proposing a machine-tool adapted to the machining of these pins and whose performance is equivalent to the most complex machines presently known in the field of robotics.

SUMMARY OF THE INVENTION

More precisely, the present invention provides a method for making an electrical connector pin from a substantially elongated cylindrical workpiece consisting:

during a first step, and performing, at a first location, a first machining operation on a first end of said workpiece while holding it by the other or second end, during a second step, moving said workpiece from the first location to the second location, this movement taking place substantially perpendicular to the workpiece axis, during a third step, performing a second machining operation on the second end while holding the first end, and so on in as many steps as required for the complete machining of the workpiece to give it a final pin form, said workpiece having undergone the previous machining operation while always moving from one location to another along a line substantially perpendicular to its axis.

Another object of the invention is to provide an apparatus allowing the implementation of said method for making electrical connector pins, comprising at least first controllable holding means for maintaining an cylindrical workpiece by one of its ends called the second end, first machining means associated with the controllable holding means, these machining means being capable of cooperating with the other or first end of the workpiece, first gripping means for seizing the blank by a first end at the outlet of said first holding means, first controllable movement means for shifting said first gripping means so that the gripped workpiece moves substantially perpendicular to its axis, second gripping means capable of cooperating with said first gripping means to seize the workpiece by its first end, second controllable movement means for shifting said second gripping means so that the gripped workpiece moves substantially perpendicular to its axis, second controllable holding means for maintaining the partially machined workpiece by its first end, and second machining means associated with said second holding means and capable of cooperating with the second end of said partially machined workpiece.

Other characteristics and advantages of the present invention will appear from the following description given with reference to the appended drawings.

DESCRIPTION OF THE PREFERRED EMBODIMENT

Figure 1:
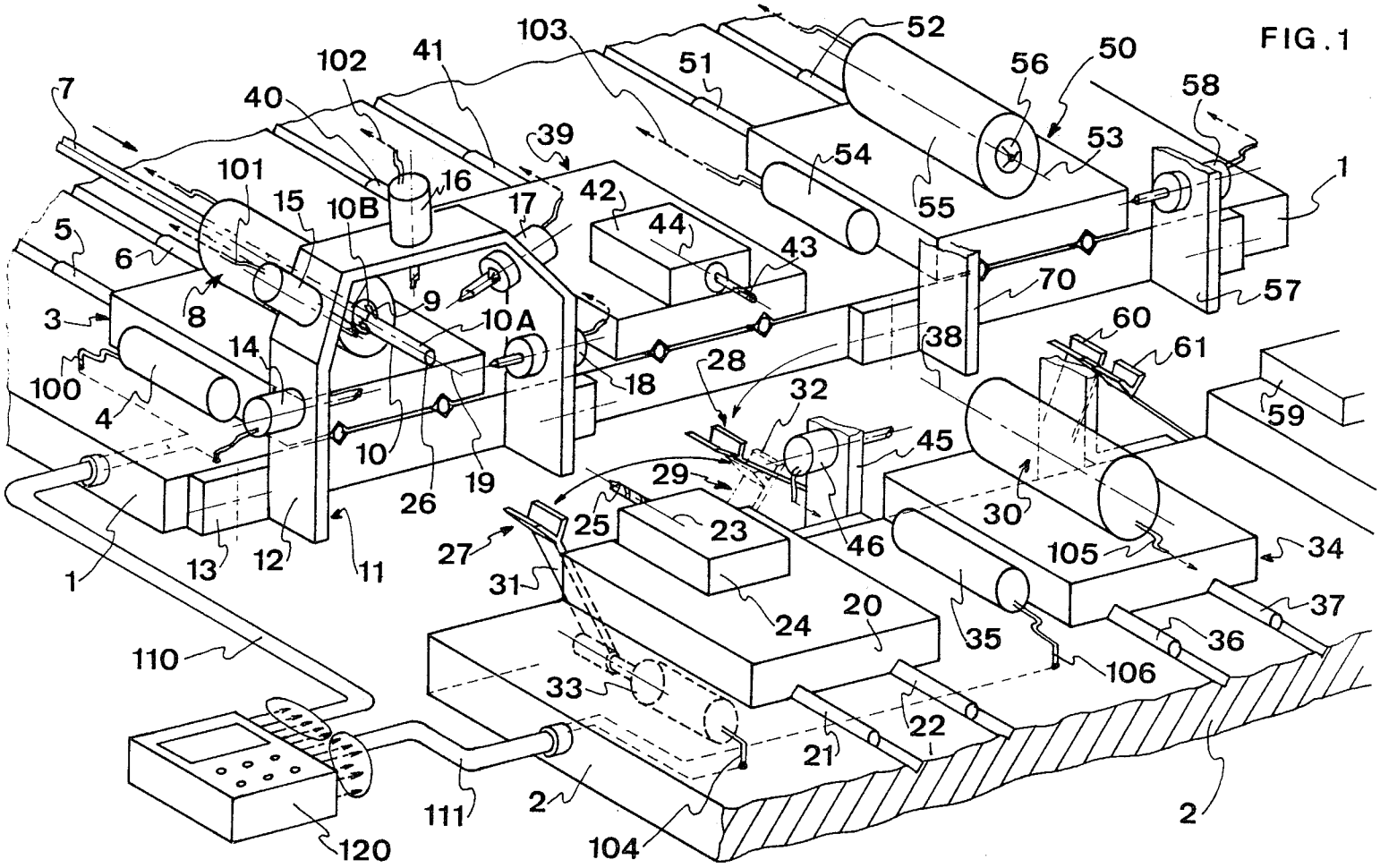
FIG. 1 is a schematic perspective representation of an embodiment of an apparatus according to the invention for the machining of electrical connector pins.

Referring more particularly to FIG. 1, the apparatus includes essentially two bases 1, 2 held securely opposite each other. More particularly, the first base 1 supports a carriage 3 capable of moving for example by means of a gear coupled with an electric motor 4, this carriage moving parallel to its longitudinal axis on two rails 5, 6 defining the movement direction.

On this carriage are placed means for holding an oblong rod 7, these holding means capable of being designed in the form of a mandrel 8. This mandrel 8 makes it possible, by means of jaws 9, to hold the rod 7 securely by its part of a cylindrical workpiece 10B so that a further part 10A it emerges from this mandrel 8. This held part 10B of the cylindrical workpiece constitutes an oblong blank from which will be made an electrical connector of any type known to the prior art.

With this carriage 8 are associated machining means 11 consisting essentially of a tool-holding arch 12 surrounding at least partially the possible movement path of the carriage 3 with its mandrel 8.

This arch 12, fixed at 13 to the base 1, by any means, includes a plurality of controllable tools 14, 15, 16, 17, 18 turned toward the center of the arch, i.e., toward the axis 19 along which the end 10 of the workpiece moves when the carriage 3 is imparted a travelling movement on its rails 5 and 6.

In a position facing this carriage 3, the base 2 supports another carriage 20 capable of moving on rails 21, 22 defining the same movement axis as that of the carriage 3, i.e., the axis 23 which is parallel and advantageously colinear with the axis 19.

The means for controlling this carriage 20 are not specifically represented, but can consist of a drive gear assembly of the same type as that shown at 4.

This carriage 20 supports a tool 24 which, in the illustrated example, consists of an automatic drill whose bit 25 appears in the axis of the blank 10 so that, if necessary, when the carriage 3 and the carriage 20 move toward each other, the bit 25 can penetrate into the face 26 of the blank 10.

Associated with these two carriages, the apparatus includes two gripping means respectively 27, 28, making it possible, when the workpiece is partially machined on the carriage 3, to seize it by its emerging end part 10A by the means 27, to be carried perpendicular to its axis from this initial position to a second position represented by 29 in FIG. 1, still held by the end part 10A, and to be taken by its other end part 10B by the second gripping means 28, and to be carried from this intermediate position by these gripping means 28, always perpendicular to its axis, to a second location to be taken by a mandrel 30 which will hold the machined workpiece by the partially machined part 10A.

These two gripping means 27, 28 can consist of swivelling arms respectively 31, 32 capable of moving perpendicular to the axis of the workpiece 10 by means of a controllable motor, for example, like the motor 33 shown partially in dotted lines in FIG 1.

For its part, the mandrel 30 is placed on a carriage 34 capable of moving parallel to the axis of workpiece 10, for example by means of a gear-motor assembly 35, on rails 36, 37 whose direction is exactly the same as that of the rails previously defined at 5, 6 and 21, 22.

Consequently, the carriage 34 with its mandrel 30 can move parallel to axis 38, and parallel to the two axes 19 and 23 previously mentioned.

Of course, this mandrel 30 includes jaws which are controllable to hold the workpiece by its end 10A which will have already undergone machining by the tools 14 to 18. This carriage 34 is advantageously designed in the same manner as the carriage 3. As previously, opposite this carriage 34 placed on the base 2, the apparatus comprises another carriage 39 maintained on rails 40, 41 on the base 1, this carriage 39 being capable of including if necessary, for example, a drill 42 whose bit 43 is placed on an axis 44 colinear with the axis 38 described above.

This bit 43 makes it possible to carry out, if necessary, a bore in the axis of the cylindrical workpiece 10 whose end part 10B emerges from the mandrel 30, it being understood that, in this condition, the workpiece will be held by its emerging end part appearing at 10A on the first mandrel 8.

As previously, with this movable carriage 34 is associated another arch 45 shown partially in the figure, but which will be designed in a manner similar or identical to that of the arch 11 associated with the carriage 3 and which will include a certain number of tools adapted to the desired machining operations, such as the one shown at 46.

These different tools, turned radially toward the inside of the arch 45 in the direction of the axis 38, may, according to the control orders sent to them, be moved to cooperate with the part of the workpiece emerging from the mandrel 30 in order to carry out the machining of this emerging part 10B.

The apparatus can include, if necessary, a third machining station with a carriage 50 capable of moving in relation to the base 1 on two rails 51, 52 parallel to an axis 53.

This carriage 50 can be moved as previously, for example by means 54 consisting of as assembly comprising a motor and a gear system, similar to that represented in FIG. 1 at 4.

On this carriage 50 is placed a mandrel 55 in which the axis of the holding jaws 56 is the axis 53 mentioned above and which is parallel to the axes 19, 23, 38. Also as previously, with this carriage 50 are associated machining means 70 which can consist of an arch 57 fixed on the base 1 and supporting an assemblage of tools such as the one illustrated in 58, it being understood that the upper portion of the arch has been eliminated, like that of the arch 45, to simplify the drawing.

As previously, in association with this carriage 50, the base 2 includes a tool 59 which can cooperate with the workpiece which will be held in the jaws 56 of the mandrel 55.

As mentioned earlier, the apparatus includes two gripping means 27, 28 in association with the two carriage assemblies 3, 20 and 34, 39.

It also includes two other gripping means 60, 61 which can move perpendicular to the workpiece 10 axis by rotation parallel to the workpiece axis by travelling.

However, more precisely, the gripping means 60 cooperate so that they can, in a first position, seize the workpiece part 10B at the outlet of the mandrel 30, holding it by the emerging end, and impart to this gripped workpiece a movement perpendicular to its axis to bring it opposite the second gripping means 61 capable of taking it by the other end part 10A which was previously held in the mandrel 30 and to bring it, always parallel to its axis, opposite the mandrel 55 to place it in the mandrel jaws 56 so that the latter hold it firmly.

Of course, as previously described, these gripping means 60, 61 can consist of arms mounted on driveshafts associated with gears and with guides so that these arms can undergo, depending on the case, rotations and/or traversing movements and hence be positioned at determined locations.

As mentioned, the apparatus includes a certain number of motors which are to be considered in the broadest sense as means making it possible to obtain the movement of two workpieces in relation to each other, or means making it possible for example to position the tools so that they cooperate with the workpiece.

Generally, in this type of apparatus, tools such as those represented by 14 to 18, 46 and 58 will consist substantially, for example, of cutters which will move along their axes to cooperate with the workpiece 10 positioned on the first mandrel 8, and the different machining widths and depths, splines, grooves, and so forth, are obtained by relative traversing and rotation of the mandrel on the axis 19 (the tool not moving laterally).

To control all these tools and motors, the outputs of the different drive elements 100, 101, 102, 103 . . . 104, 105, 106 . . . etc, are connected by connectors 110, 111 to a central drive unit 120 including different means for monitoring, control, actuation, etc. This unit is composed advantageously of a computer and/or microprocessor in which the different control operations are prerecorded so that no human intervention is necessary from the start of machining on the blank to the completely machined electrical connector pin.

The operation of the apparatus described above in the manufacture of an electrical connector pin is the following: First of all, it is pointed out that the cylindrical workpiece to be machined in order to obtain the completed pin will be referenced in two parts which, referring to FIG. 1, will be respectively the part 10A which appears at the outlet of the mandrel 8, and the end part 10B which is held in the mandrel 8 and which does not appear in FIG. 1.

Figure 2:
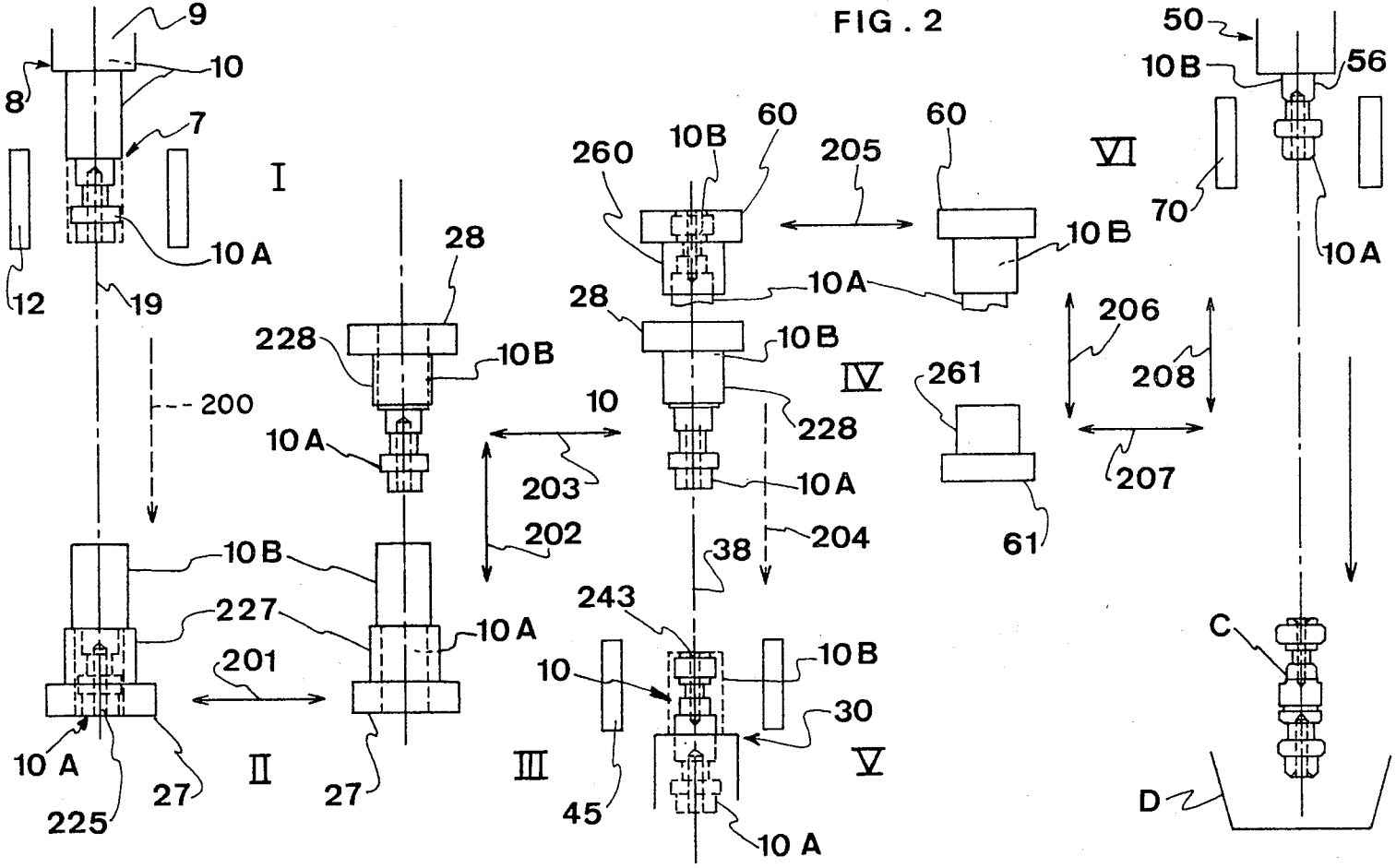
FIG. 2 is a schematic flow diagram of part of the apparatus of FIG. 1, representing essentially the principle of the movement of the main components contributing to the operation of said apparatus.

Based upon these considerations, FIG. 2 represents the different successive steps undergone by the oblong blank or cylindrical workpiece 10 beginning with an initial structure bearing the reference 7 in FIG. 1.

To manufacture a completely finished pin such as the one appearing at C at the end of the different steps illustrated in FIG. 2, the apparatus is supplied by a filiform bar or rod 7 having a diameter greater than the final diameter of the pin when it is completely machined.

Thus, in a first operation, the end of the rod 7 is introduced through the rear side of the mandrel 8 until the workpiece end part 10A appears at the outlet of the jaws 9.

The mandrel and its feeding means controlled by the different inputs make it possible to give a predetermined length to this part 10A emerging from the jaw 9.

When the end part 10A is correctly positioned and the jaws 9 have been operated to hold the end part 10B firmly, the carriage 3 is actuated so that it advances along the axis 19 in accordance with arrow 200 and so that if necessary the jaws 9 can be rotated on this same axis 19.

Simultaneously, the control unit 120 gives orders to the different tools 14 to 18 so that they operate on the workpiece end part 10A and, by turning, milling, etc., carry out in said end the configuration as illustrated in position I of FIG. 2.

As soon as the workpiece part 10A has been machined, the carriage 3 advances further along its axis 19 as per arrow 200 to position the workpiece end part 10A in the gripping means 27, notably in the bushing 227 where it is seen that the part 10A is held by the latter but that, on the contrary, the part 10B now is free (position II).

Once the part 10A has been gripped in the bushing 227, the means 27 undergo a traversing motion along 201 so that the bushing occupies the position III and moves opposite the gripping means 28 with its bushing 228.

The control unit 120 then gives an order to the gripping means 28 so that they are traversed along 202 and so that the bushing 228 mates with the part 10B.

As soon as this part 10B has been gripped by the bushing 228, the bushing 227 releases the part 10A, and the arm 28 is traversed along 202 but in the direction opposite the preceding, followed by a second traversing motion along 203 perpendicular to the preceding so that the gripping means 28 move opposite the gripping means 60 and assume the position IV shown in FIG. 2.

When the gripping means have assumed this position IV, the carriage 34 with its mandrel 30 advances by traversing along 204 on the axis 38 and, with its jaws, takes and holds the workpiece 10 by its end part 10A as shown in position V. In this position, the workpiece 10 is held by its end part 10A and the end part 10B is freed.

The carriage can then be traversed with the possible rotation of the mandrel 30 so that the tools held on the arch 45 can machine the workpiece part 10B and give workpiece 10 a profile such as the one shown in position V with grooves and projecting parts.

If necessary, as moreover in phase I, the flat face of the end part 10B can be brought opposite the bit 43 and can be drilled as shown at 243. Of course, in this phase I, the other end part 10A could have also undergone drilling 225 if this were necessary, by means of the drill 24 and the bit 25. This drilling would have been carried out, depending on the case, by bringing the carriage 30 toward the carriage 20 and vice versa, or even by bringing the carriages 3 and 20 toward each other. Once the machining has been carried out on the end part 10B, in phase V, a gripping arm 60 is brought opposite the carriage 20 and grips the workpiece by its end part 10B, this gripping occurring owing to the fact that the carriage 34 undergoes a parallel traversing 204 so that the workpiece 10 is positioned in the gripping arm 60.

The gripping arm 60, as soon as it has gripped the workpiece 10 by its end part 10B, undergoes traversing along 205 to bring it opposite the gripping arm 61. If necessary, the gripping arm 61 is traversed along 206 so that its bushing 261 mates with the free end part 10A.

As soon as the bushing 261 has mated with the end part 10A, the bushing 260 releases the end part 10B. The gripping arm then undergoes a traversing motion along 206 in the direction opposite the preceding, along with two other traversing motions 207 and 208 respectively perpendicular and parallel to the traversing motion 206 so that the bushing 261 is opposite the jaws 56 of the mandrel 55, it being understood that the end 10B has remained free.

Consequently, the jaws 56 are actuated to mate with the end 10B and to hold it, the end part 10A remaining free.

In this phase of operation VI, the carriage 50 and the mandrel 55 can be actuated to move under the tool-holding arch 70 and undergo another cycle of machining operations, for example for bevelling.

Once these operations are completed, the carriage 50 and the jaws 56 can be actuated to release the workpiece 10 which is completed. The pin is ejected toward a reception outlet D shown schematically in FIG. 2. Of course, in the preceding description, these different operations are possible very rapidly owing essentially to the fact that the workpiece 10 from phase I to phase VI always remains parallel to itself in all its movements.

Moreover, owing to the breakdown of these machining operations, the apparatus makes it possible to manufacture simultaneously several electrical connector pins according to the masked time process.

In fact, when the first phase I is completed and the second phase II is being carried out, when the workpiece 10 has been cut at the outlet of the mandrel 8, when it is held in the gripping arm 27, the rod 7 can continue to advance to prepare a second workpiece 10 which will be machined while the preceding one is being transferred to the next machining station, for the phase II to III and so on up to the phase VI.

With the apparatus illustrated in the figure, it is possible to make at least five or six electrical connector pins simultaneously, thereby minimizing the dead time.

The advantage of such a machine are evident since it in fact does not require many complex means. The mandrels, motors, gripping arms and tools can be controlled very simply by electrical orders stored in the unit 120 since it is quite evident that all the movements undergone by the workpiece during a complete machining cycle are in fact only elementary traversing movements, except for the rotation of the mandrels but this rotation does not involve any particular difficulty.

The value of such a machine is thus obvious for the manufacture of electrical connector pins, it being pointed out that by pin is meant any mechanical part having a substantially oblong form, for example a cylindrical form, allowing the establishment of an electrical connection, notably by direct or indirect contact between at least two electrical conductors of any form and type whatever.

What is claimed is:

1. Method for making an electrical connector pin from a substantially cylindrical workpiece, said method comprising the steps of:

performing, at a first location, a first machining operation on a first end part of said cylindrical workpiece while holding it by the other, second end part, moving said workpiece from the first location to the second location, while maintaining the axis of the workpiece substantially perpendicular to the direction of movement, following the second step, performing a second machining operation on the second end part while holding said first end part, and repeating the steps above as required for the complete machining of said cylindrical workpiece to give it a final form, after said workpiece having undergone the previous machining operations and maintaining the orientation of the workpiece such that its axis is generally perpendicular to the direction of movement from one location to another, such that at said positions, alternate end parts of said workpiece are exposed for machining.

2. The method as claimed in claim 1, wherein, at each of said locations, said method includes moving said cylindrical workpiece axially while rotating said workpiece and moving machining means radially into engagement with said workpiece at one end part to effect machining thereof and relatively moving said cylindrical workpiece along its axis subsequent to machining of said one end part to effect gripping of said cylindrical workpiece at said one end part, and releasing said other end part, prior to moving said workpiece from said first location to said second location.

3. The method as claimed in claim 1, wherein at any of said locations, the step of performing a machining operation includes moving said cylindrical workpiece axially while rotating said workpiece about its axis with at least one machining means moving radially into contact with one end part of said cylindrical workpiece to effect machining about the periphery of said cylindrical workpiece, and additionally effecting relative movement of another machining means parallel to the axis of said cylindrical workpiece and into contact with the end face of said cylindrical workpiece one end part while rotating said cylindrical workpiece about its axis.

4. The method as claimed in claim 3, wherein at each location, there is a mandrel mounted to a carriage for rotation about the mandrel axis, and said carriage is mounted for movement in a direction parallel to the axis of the mandrel, and wherein said step of performing a machining operation at each location comprises causing said mandrel to move relative to the cylindrical workpiece to engage one end part of said workpiece, and to hold that end part, rotating said mandrel relative to at least one radially displaceable machining means while moving said machining means radially into contact with the periphery of said cylindrical workpiece of the other end part.

5. The method as claimed in claim 4, wherein said machining means consists of a plurality of tools mounted to a fixed arch surrounding the path of movement of said carriage and said mandrel placed thereon, and wherein said method includes selectively causing a given one of said tools to be shifted on said fixed arch so as to move radially into engagement with the non-held part of said cylindrical workpiece during movement of the carriage at right angles to the plane of said arch.

* * * * *